US006169486B1

(12) United States Patent
Berkcan et al.

(10) Patent No.: US 6,169,486 B1
(45) Date of Patent: Jan. 2, 2001

(54) MONITORING AND CONTROL SYSTEM FOR MONITORING THE TEMPERATURE OF A GLASS CERAMIC COOKTOP

(75) Inventors: Ertugrul Berkcan, Niskayuna; Emilie Thorbjorg Saulnier, Rexford, both of NY (US)

(73) Assignee: General Electric Company, Schenectady, NY (US)

( * ) Notice: Under 35 U.S.C. 154(b), the term of this patent shall be extended for 0 days.

(21) Appl. No.: 09/356,964

(22) Filed: Jul. 19, 1999

(51) Int. Cl.[7] ..... G08B 17/00

(52) U.S. Cl. ..... 340/584; 340/588; 340/589; 340/600; 340/643; 219/464

(58) Field of Search ..... 340/584, 588, 340/589, 600, 619, 622, 640, 643; 219/464

(56) References Cited

U.S. PATENT DOCUMENTS

| | | | | |
|---|---|---|---|---|
| 4,237,368 | | 12/1980 | Welch . | |
| 4,493,981 | * | 1/1985 | Payne | 219/450 |
| 4,740,664 | * | 4/1988 | Payne et al. | 219/449 |
| 4,812,624 | * | 3/1989 | Kern | 219/450 |
| 4,816,647 | * | 3/1989 | Payne | 219/464 |
| 5,138,135 | | 8/1992 | Husslein et al. . | |
| 5,430,427 | * | 7/1995 | Newman et al. | 219/464 |
| 5,958,272 | * | 9/1999 | Taplan et al. | 219/464 |
| 5,961,867 | * | 10/1999 | McWilliams | 219/446.1 |

FOREIGN PATENT DOCUMENTS 0806887 11/1997 (EP) .

OTHER PUBLICATIONS

"Method and Apparatus for Boil State Detection Based on Acoustic Signal Features," E. Berkcan et al., Serial No. 09/273,065 (GE docket RD–26098), filed Mar. 19, 1999.

"Acoustic Sensing System for Boil State Detection and Method for Determining Boil State," E. Berkcan et al., Serial No. 09/273,064 (GE docket RD–26042), filed Mar. 19, 1999.

"Method and Apparatus for Boil Phase Detection," P. Bonanni et al., Serial No. 09/211,161 (GE docket RD–26420) filed Dec. 14, 1998.

* cited by examiner

*Primary Examiner*—Jeffery A. Hofsass
*Assistant Examiner*—Daniel Prévl
(74) *Attorney, Agent, or Firm*—John F. Thompson; Jill M. Breedlove

(57) ABSTRACT

A system is disclosed for determining the temperature of a cooktop having an upper surface and a lower surface. At least one controllable energy source is located below the lower surface of the cooktop to heat the area above the energy source on the cooktop, and at least one sensor with at least one detector to detect infrared radiation from the cooktop above the energy source. The level of infrared radiation is representative of the temperature of the cooktop, which may be glass ceramic. The sensor provides a signal indicative of the temperature of the cooktop which is then used to control the energy source in order to protect the cooktop from extreme temperatures. The signal may be alternatively utilized to provide an indication of a hot cooktop surface after the energy sources have been turned off. The signal optionally is also utilized to provide automatic control of the energy source to maintain a predetermined temperature, or to prevent exceeding a maximum temperature.

37 Claims, 7 Drawing Sheets

60

MONITORING AND CONTROL SYSTEM FOR MONITORING THE TEMPERATURE OF A GLASS CERAMIC COOKTOP

BACKGROUND OF THE INVENTION

The present invention relates to a monitoring and a control system for determining and controlling the temperature of a cooktop, and more particularly a system having one or more sensors and one or more filters to sense infrared radiation emanating from the cooktop in an area above a controllable radiating energy source, and the level of infrared radiation being representative of the temperature of the cooktop.

Recently, standard porcelain enamel cooktop surfaces of domestic ranges have been replaced by smooth surface, high resistivity cooktops located above one or more heat sources, such as electrical heating elements, or gas burners. The smooth surface cooktops improve cleanability because there are no seams or recesses in which debris can accumulate. The continuous cooktop surface also prevents spillovers from coming into contact with the heating elements or burners. Such cooktops may be milkwhite, opaque, glass ceramic or crystal and glass material sold under various trade names. Glass ceramic material is used frequently because of its low coefficient of thermal expansion and smooth top surface that provides a pleasing appearance.

The high thermal mass of the glass ceramic material has a slow thermal response, thereby requiring a longer time to heat up and cool down. The heat is stored in the glass ceramic cooktop, as well as in the sheathed heating element, or the insulating support block or pad for the heating element. When open coil heaters are used at a spaced distance below the cooktop, there is also poor thermal coupling between the heat source and the glass ceramic cooktop. In order to transfer a requisite amount of heat from an open coil heater to the glass ceramic plate, the heat source has to operate at a higher temperature than otherwise, which creates problems, such as poor system efficiency, high heat losses, component overheating and high cooktop temperatures. Glass ceramic cooktops in surface units with open coil heaters also may present a safety hazard in the event the cooktop is broken.

Another type of surface cooking units utilize solid state, induction cooking systems. The basic mechanism of induction cooking comprises an alternating magnetic field coupled across a gap with a utensil bottom, which acts as a single turn secondary winding. One or more induction heating coils are located below a ceramic, glass, or plastic cooking surface which may be in the form of a substantially unbroken utensil support plate. A complete induction surface cooking unit preferably employs a static power conversion circuit including a filter and an inverter for converting a filtered unidirectional voltage to ultrasonic power for driving the induction heating coil. Components for cooking, in addition to the gating circuit for the inverter power devices, include an inhibit circuit for selectively inhibiting operations of the inverter, start-up and shut-down devices coupled to the inhibit and gating circuits for controlling transients and the application and removal of voltage from the inverter, a protection device, output power adjusting devices and user controls. The power output of the inverter is modulated to change the heating level in the utensil and, therefore, the temperature at which the food is cooked. Static power converters, especially those with semiconductor components, require protection to prevent malfunction and failure under abnormal circuit conditions, such as over voltages and over currents. Furthermore, the coupled utensil is the inverter load and the reflected impedance changes the inverter's electrical parameters. There are severe load requirements if the unit is to be operable with a variety of utensils of different sizes and materials, under both load and no-load conditions. The requirement for automatic and continuous operation means that the circuit design must anticipate circumstances that could cause failure or temporary shutdown.

Thus, a need exists for a system to determine the temperature of the cooktop and to utilize a signal generated by the system to aid in the automatic control of the heat source, provide user feedback to increase safety, to increase the life of the components and to increase energy savings.

SUMMARY OF THE INVENTION

A monitoring and control system is disclosed for determining the temperature of, and controlling the temperature of a cooktop, which preferably is glass ceramic, having an upper surface and a lower surface. At least one controllable heat source is located below the lower surface of the cooktop to heat the cooktop area above the heat source, and at least one sensor is provided to sense infrared radiation from the glass ceramic cooktop above the heat source. The level of infrared radiation selected in a particular band is representative of the temperature of the cooktop.

The sensor provides a signal indicative of the temperature of the cooktop which can then be used to control the heat source in order to protect the cooktop from extreme temperatures, or the signal may be utilized to provide an indication of a hot cooktop surface to alert the user. The signal can also be utilized to provide automatic control of the heat source to maintain a predetermined temperature, or to prevent exceeding a maximum cooking temperature on the cooktop above the heat source.

The present invention utilizes an optical detector to "look" at the cooktop or detect the level of infrared radiation in a particular band to detect the temperature thereof. The cooking surface temperature can then be controlled using the absolute temperature and the associated temperature gradient through the thickness of the cooktop to provide a signal which may be used to protect the glass ceramic from extreme temperatures, provide an indication of a hot surface after the heat source has been turned off, and/or to provide a temperature-based control of the heat source.

The signal used in the system originates in the infrared radiation from the cooktop. The existence and the level of the infrared radiation from the cooktop can be measured using an optical sensor assembly opening into the heating chamber between the heat source and the cooktop. The level of infrared radiation is representative of the temperature of the cooktop. The range of wavelengths sensed by the optical sensor can be controlled to enable the sensor to monitor either the surface temperature of the cooktop, or the internal temperature of the cooktop. This information can also be used to determine the heat flux through the cooktop by also considering the temperature gradient through the cooktop by using two different wavelength ranges of sensitivity.

The system according to the present invention envisions the measurement of the temperature of the cooktop using an optical sensor to sense some portion of the underside of the cooktop from a location at the edge, side, or bottom of the heat source. An optical waveguide may be utilized to direct the infrared radiation onto the detector. However, due to the thermal environment and manufacturing considerations, the optical waveguide may not extend into contact with the underside of the cooktop. In this situation, there may be significant signal interference resulting from reflections from the cooktop surface. Filters used to select wavelength ranges may be utilized to filter out the reflective component of the radiation and to avoid interference by other sources of radiation.

The transmission band of the filters may be tailored to select the specific wave length ranges for determining the temperature of the surface of the cooktop, or to determine the sub-surface temperature of the cooktop. For instance, infrared radiation substantially around the 5$\mu$ (microns) range may be utilized to detect the surface temperature, while wavelengths equal to or greater than 3.5$\mu$ range, for example, may be utilized to measure the sub-surface temperature of the cooktop. Wavelengths substantially closer to the 7$\mu$ range may be sensed in the instance where there are large temperature gradients in the cooktop.

Another feature of the system according to the present invention is the use of the field of view of the entrance of the optical waveguide to determine which part of the cooktop is sensed. Aside from shaping the waveguide to increase the signal value for the sensor, this concept can also be used to focus the sensor on particular spots, or to provide a broad coverage of a larger cooktop area.

DETAILED DESCRIPTION OF THE INVENTION

Figure 1:
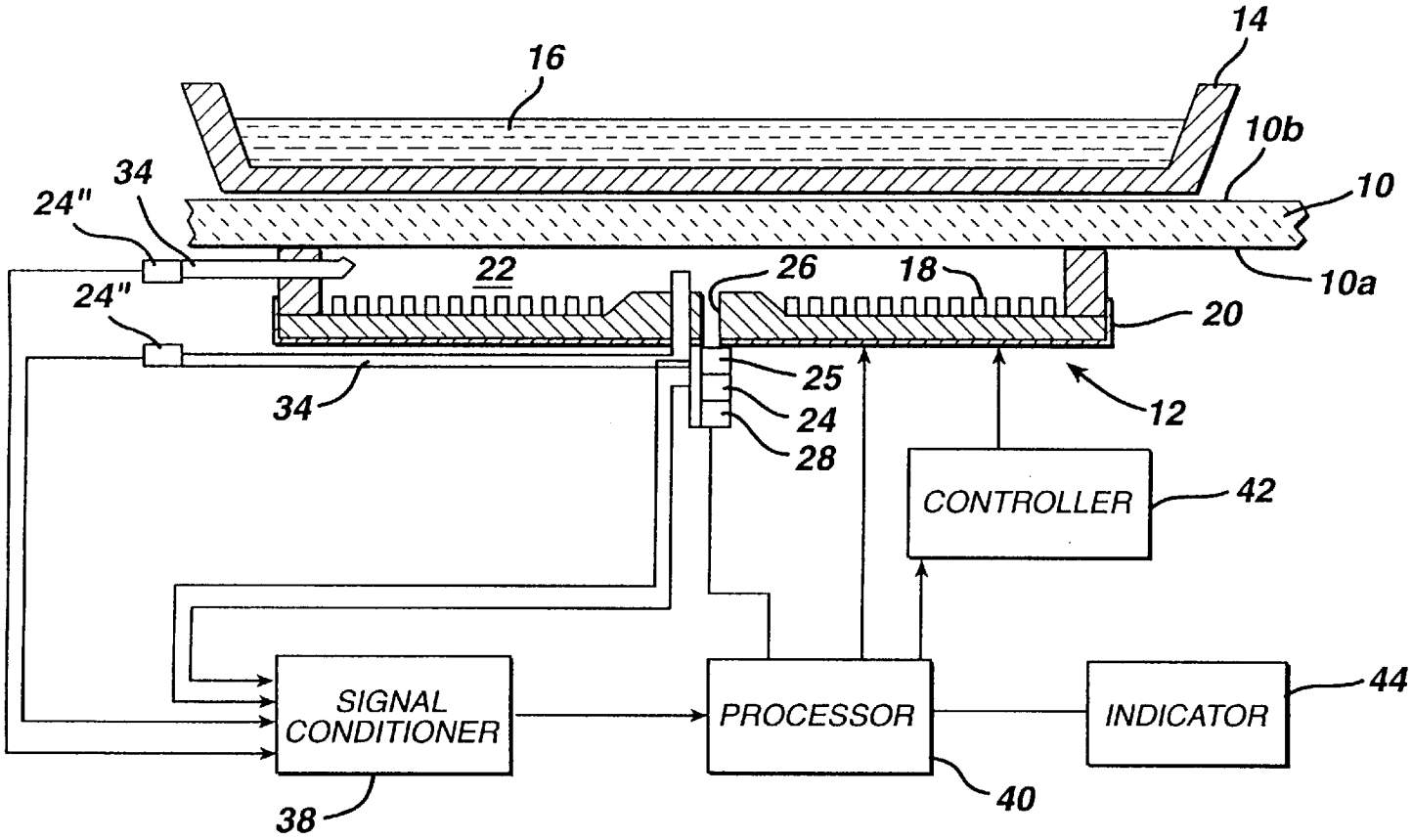
FIG. 1 is a schematic cross-sectional view of a glass ceramic cooktop incorporating the system according to the present invention.

The system according to the present invention utilizes a sensor having a radiation collector, one or more concentrators, one or more optical detectors and any corresponding filters to limit the range of infrared radiation sensed by the optical detectors. In addition, the system may include amplifying and filtering means in the form of interface electronics, as well as means of multiplexing the temperature responsive signal between different sensors.

A radiation collector is an optical system used to collect optical radiation from the field of view by using imaging or non-imaging optics, and concentrators. A concentrator is an optical system that transmits and compresses an incident beam of optical radiation from an input aperture of area to an output or exit aperture of area such that all the transmitted rays emerge from the exit aperture, and the ratio of the respective areas is as close to the theoretical maximum as possible. The field of view of the optical sensor is the area of the glass ceramic that is subtended or viewed by the optical system such that the rays emanating from any portion within this said area impinges onto the detector of the optical sensor. The field of view coincides with the desired sensing area or location.

Filters for selected portions of the spectrum are used to limit the spectrum of the observed radiation such that the level of the signal best represents the cooktop temperature. The filter can be further utilized to minimize interference caused by reflection and other radiation components, such as that generated by ambient lighting, reflection from the cooktop, as well as non-cooktop reflection.

A transmission path or guiding path including a waveguide, or other form of imaging and non-imaging optics is utilized to enable the optical detector to be positioned at a remote location independent of the desired sensing location within the chamber between the heat source and the cooktop. This remote location enables the optical detector to operate in a more favorable thermal environment, or to optimize other design considerations, such as the location of other optical detectors, or the sharing of the optical detectors among several heat sources, or cooling advantages. The waveguide parameters include the field of view into heating chamber, the diameter, the length and the material, from which it is fabricated. A concentrator may be utilized to increase signal strength at the input end, and/or the exit end of the waveguide. Imaging optics is an image forming optical system including reflective and refractive surfaces. Non-imaging optics is an optical system including reflective and refractive surfaces. The transmission path (or guiding path) is a collection of imaging and non-imaging optical system and free space that guides and delivers all the optical radiation from its input aperture to its exit aperture. The entrance aperture of the transmission path is the exit aperture of the radiation collector, and the exit aperture is the entrance aperture of the concentrator. The transmission path can contain segments where the direction of travel of the radiation is bent.

As best seen in FIG. 1, the cooktop 10 has a lower surface 10*a* and an upper surface 10*b* and at least one controllable energy source 12 located beneath the lower surface 10*a*. Preferably, cooktop 10 is made of glass ceramic. The upper, cooking surface 10*b* is the surface on which a cooking utensil 14 is placed to heat the contents 16. The energy source 12 typically will comprise a heating coil 18 located within a burner casing 20 and will form a heating chamber 22 between the heating coil 18 and the lower surface 10*a* of the cooktop 10. In known fashion, the heating coil 18 is utilized to provide heat to the heating chamber 22 which, in turn, heats the cooktop 10, the utensil 14, and the contents 16. An energy source control 42 is operatively connected to the at least one controllable energy source 12 and also to a processor 40.

Optical detector 24 optionally is located directly below the burner casing 20 and optionally "views" the ceramic cooktop 10 through an opening or a radiation collector, or a short wave guide 26 through the burner casing 20. In this case, a short waveguide 26 or other transparent medium is used to protect the detector or to guide or focus the radiation. The infrared radiation from the ceramic cooktop 10 passes through the opening or the short wave guide 26 and impinges on the optical detector 24; the filter used on the optical detector is not shown. The optical detector 24, due to its location and the construction may need to be temperature compensated to provide meaningful signals without undue influence from the heat generated by the coil 18. The temperature compensation may be accomplished by using a signal indicative of the ambient temperature around the sensor 24 or a temperature sensor such as a thermistor 28 which measures the temperature of the optical detector 24 and which may be connected to software programs in the processor 40 using two separate channels of an A/D converter, illustrated generally as signal processing circuitry 38. This software program calculates a correction based on the output of the temperature sensor 28 and the filter 25 used on the optical detector 24. The signal processing circuitry 38 is a known signal processing circuitry that includes low pass filtering and amplification by a gain factor G, such as amplifier device 224 shown in FIG. 2. This compensation is carried out by temperature compensation calculation within processor 40. Ambient temperature sensor, the resistor 28, which indicates the ambient temperature at the location of the optical sensor 24, is connected to sensor conditioning circuitry 38 and further connected to the processor 40 for passing an ambient temperature signal to the temperature compensation calculator, not shown, which includes software programs arranged to calculate a temperature compensated signal. These software programs calculate a correction based on the voltages obtained from the output of the temperature sensor 28 and the optical sensor 24. For a broad band filter, for example, the calculation carried out by the processor 40 is:

$$V_{comp}=V_{opt}+C_{rem}T_C^4$$

where $V_{comp}$ refers to the calculated output of the optical sensor 24, $T_c$ refers to the output of temperature sensor 28 expressed in degrees Kelvin, and $c_{rem}$ is a constant that depends on the calibration of the sensor and its housing details. The term $V_{opt}$ then refers to the temperature compensated optical sensor output.

Figure 2:
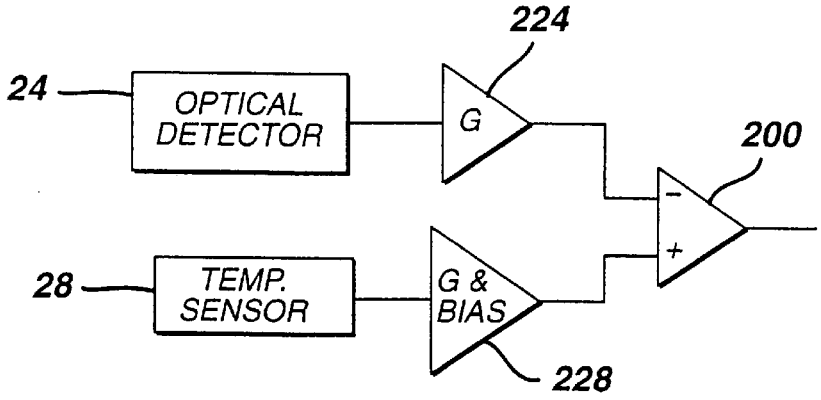
FIG. 2 is a schematic diagram of a circuit for temperature compensating the sensor utilized in the system according to the present invention.

The temperature compensation may also be accomplished by hardware as illustrated in FIG. 2. FIG. 2 is a schematic diagram of a circuit for temperature compensating the sensor utilized in the system according to the present invention. In the hardware implementation for temperature compensation, the output of the optical sensor 24 optionally is amplified by a gain stage 224. Similarly, the output of the temperature sensor 28 is connected to a bias circuit depending on its type, and amplified by the circuit 228. The outputs of these two circuits are connected to circuit 200, which is, for example, an operational amplifier, where the temperature signal from the temperature sensor 28 is used to offset the circuit 200.

As shown in FIG. 1, some illustrative alternative locations for the optical detector 24 are illustrated at 24' and 24". In these positions, the optical detector 24 is remotely located away from the heat of the heating coil 18 and burner casing 20 to a location which provides more optimal operating conditions. In order for the detectors 24', 24" to receive radiation from the field of view (not shown) on the lower surface 10*a*, an optional transmission path 34 is utilized. The transmission path 34 consists of a waveguide comprising a hollow, tubular element having an inner surface which provides good infrared radiation reflectivity and very low emissivity. Alternatively, the transmission path 34 is filled with an infrared (IR) transmitting material such as $Al_2O_3$, or other IR transmitting material, illustrated at 46 in FIG. 4. The glass ceramic itself of the cooktop 10 between the lower surface 10*a* and the upper surface 10*b* is optionally utilized as the transmission path.

Figure 3:
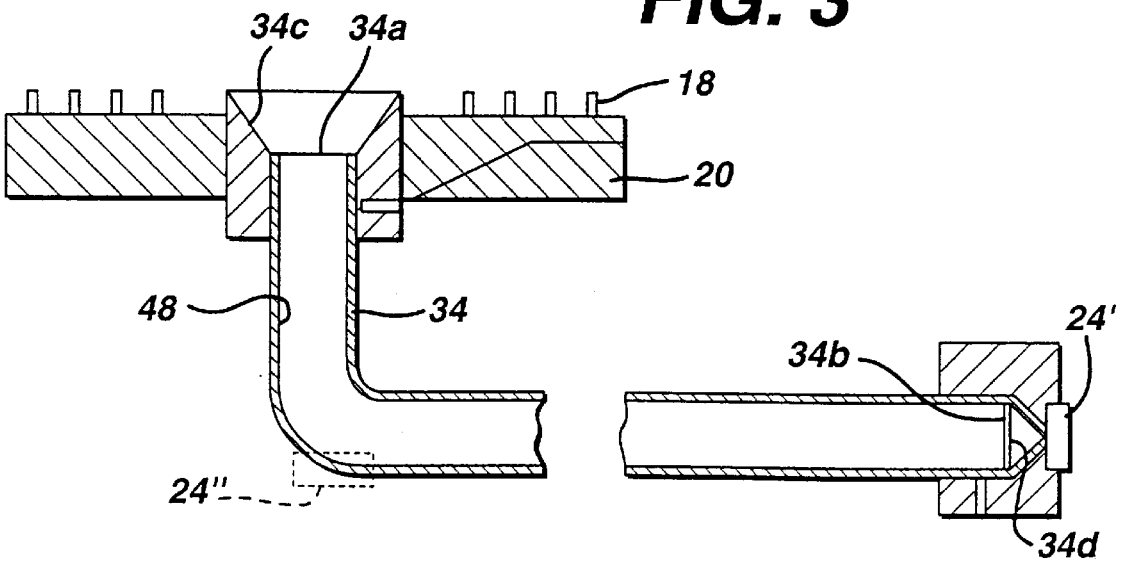
FIG. 3 is a cross-sectional view of a waveguide assembly utilized with the system according to the present invention.

As seen in FIG. 3, the transmission path 34 has an inlet end or input aperture 34*a* and an exit end portion or an exit aperture 34*b* through which the infrared radiation passes to impinge upon the optical detector 24'. Preferably, transmission path 34 is provided with an internal coating 48 that is an excellent infrared reflector and has very low emissivity. Gold is a preferred internal coating material because of its high reflectivity and low emissivity. To prevent the tube material, which is preferably a metal such as copper, from bleeding into the internal coating, a barrier layer is deposited between the metal tube and the internal coating. Alternatively, the barrier layer comprises any suitable material, such as nickel or nichrome. The inlet end 34*a* of the waveguide 34 optionally has a radiation collector 34*c* which concentrates the radiation entering the waveguide 34. The radiation collector preferably has a shape including a frustoconical surface, a paraboloid of revolution, and a compound parabolic concentrator.

Similarly, the exit end portion 34*b* optionally has a concentrator 34*d* so as to further concentrate the radiation exiting from the transmission path 34 onto the optical detector 24'. The transmission path 34 does not have to be tubular, and optionally, it is made of a solid material that is optically conducting to the radiation in the selected wavelength range.

Figure 4:
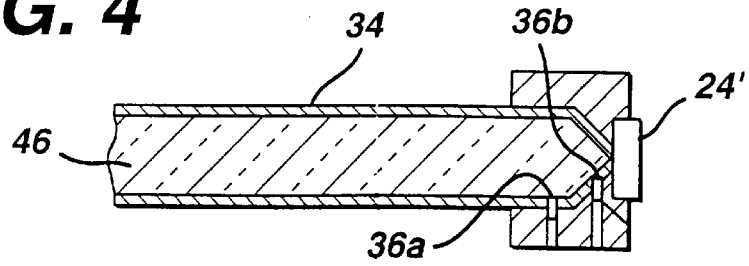
FIG. 4 is a partial, cross-sectional view of an alternative embodiment of the exit end portion of the waveguide according to the present invention.

As illustrated in FIG. 4, optionally, additional optical detectors are utilized. In this alternative embodiment, an additional optical detector is located at 36*a*, or is located within the concentrating surface at 36*b*. The multiple detector configuration optionally has optical detectors with two different ranges of wavelength sensitivity, to provide a measurement of flux and emissivity independent temperature values discussed below. The different wavelength ranges are utilized to sense the temperature at the surface of the cooktop 10, or to measure the sub-surface temperature of the cooktop 10.

The detectors that are used in the present system include thermal detectors and quantum detectors, or other detectors that are made to be sensitive to the desired infrared radiation region or a broadband detectors. The quantum detectors are detectors with a responsive element that is sensitive to the number or mobility of free charge carriers such as electrons and holes are that are brought about by the incident infrared photons, and are also known as photon detectors. Examples of photon detectors include silicon, germanium, InGaAs, etc. A thermal detector is a detector whose responsive element is sensitive to temperature brought about by the incident radiation, and includes thermopile and bolometric detectors. A second relatively narrow band quantum detector, such as a silicon or germanium photo-diode, is used as an alternative to single broadband detector to separate the wavelength sensitivity and increase the specificity and the sensitivity of the sensor assembly.

Figure 5:
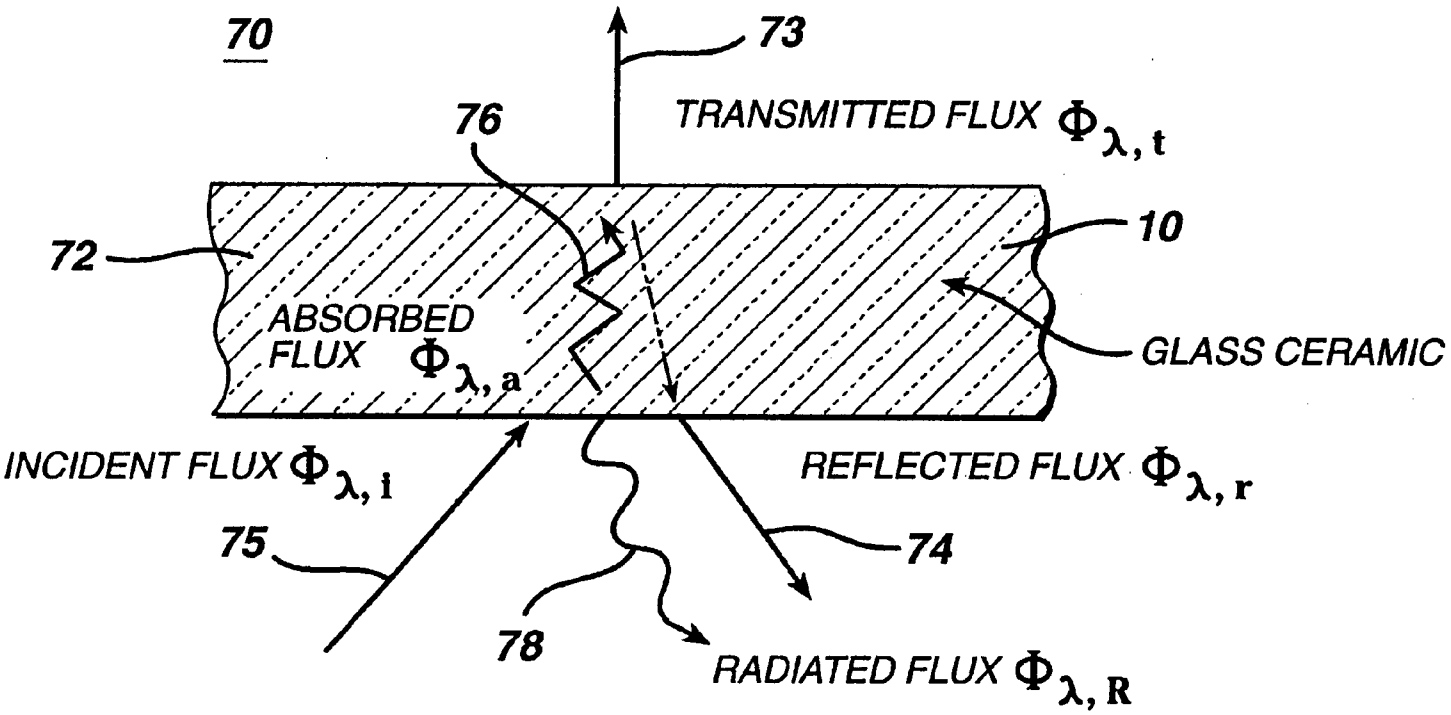
FIG. 5 is a partial, cross-sectional view of a glass ceramic cooktop with the various components of the energy flux shown.

FIG. 5 is a partial, cross-sectional view of the glass ceramic cooktop with the various components of the energy flux shown. Optical flux is the radiant power traversing a particular given surface, and is typically measured in Watts. The glass ceramic 10 has transmission and reflection characteristics that are illustrated later. The various components of the flux include the incident flux 75, the reflected flux 74, as well as the absorbed flux 72 and the transmitted flux 76. This transmitted flux 76 give rise to the further radiated and transmitted component 73, which contributes to the heat transfer properties of the glass ceramic. Another important component of the flux is the radiated flux 78, which constitutes the main component of the flux that is sensed to determine the glass ceramic cooktop temperature according to the present invention.

Figure 6:
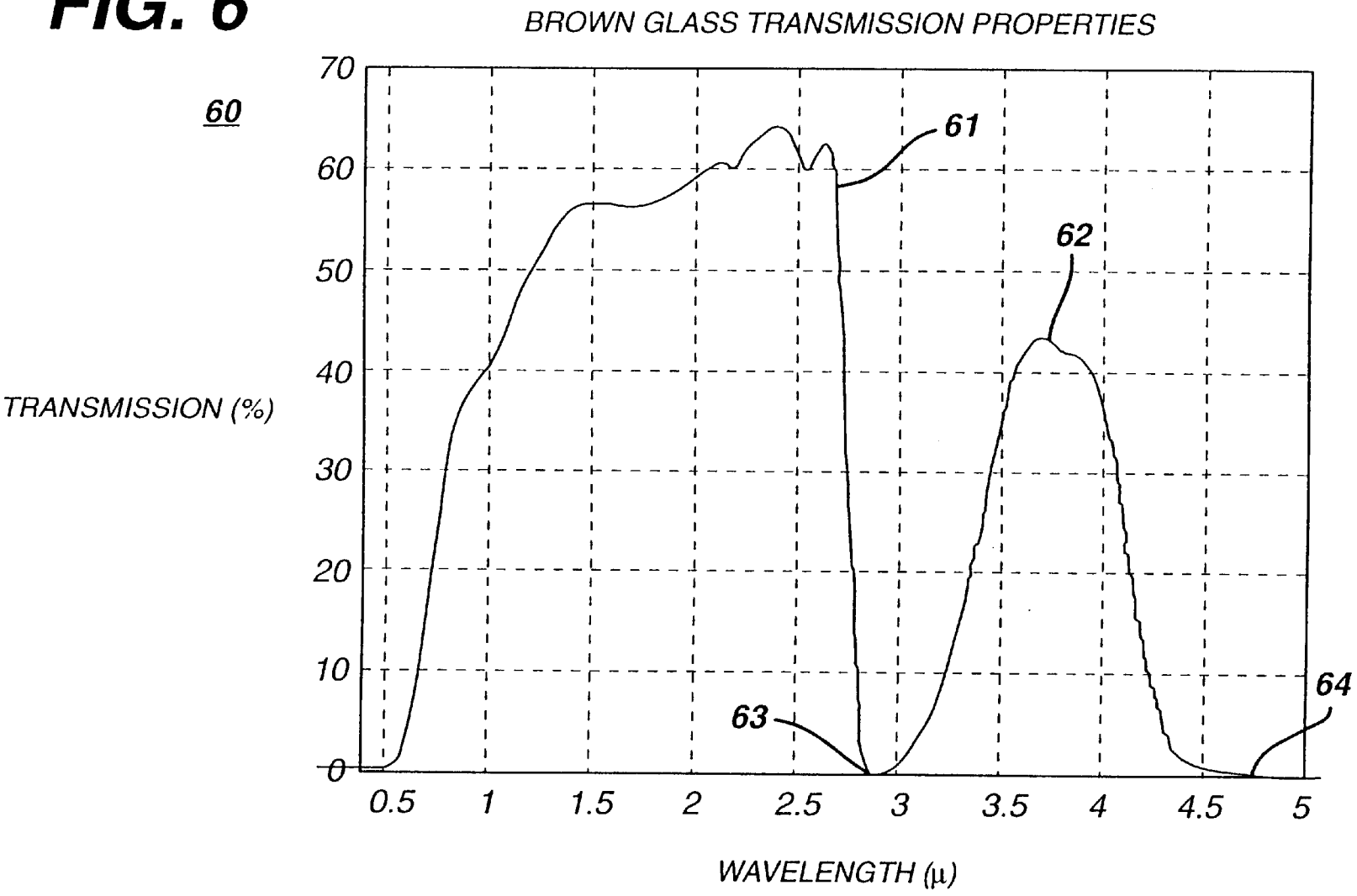
FIG. 6 is a graph of the transmission properties of a typical glass ceramic cooktop.

FIG. 6. Is a graph of the transmission properties 60 in the $0.5\mu$–$5\mu$ wavelength region of a typical glass ceramic cooktop. The two broad peaks 61 and 62 represent relatively good transmission. Between these two peaks, there is a narrow region 63 with substantially no transmission. The peak 62 resolves to a region 64 of wavelength where there is no longer any appreciable transmission. The transmission beyond $5\mu$ is essentially equal to zero, and is not shown. The preferred wavelength sensitivity range of the sensors according to the present invention include the ranges where the transmission through the glass ceramic is substantially equal to zero; these wavelength ranges are referred to as the opaque wavelength region. The narrow region 63, as well as the region past the point 64 are examples of such wavelength ranges, but such regions are also dependent on the reflection properties of the glass ceramic, as discussed next.

Figure 7:
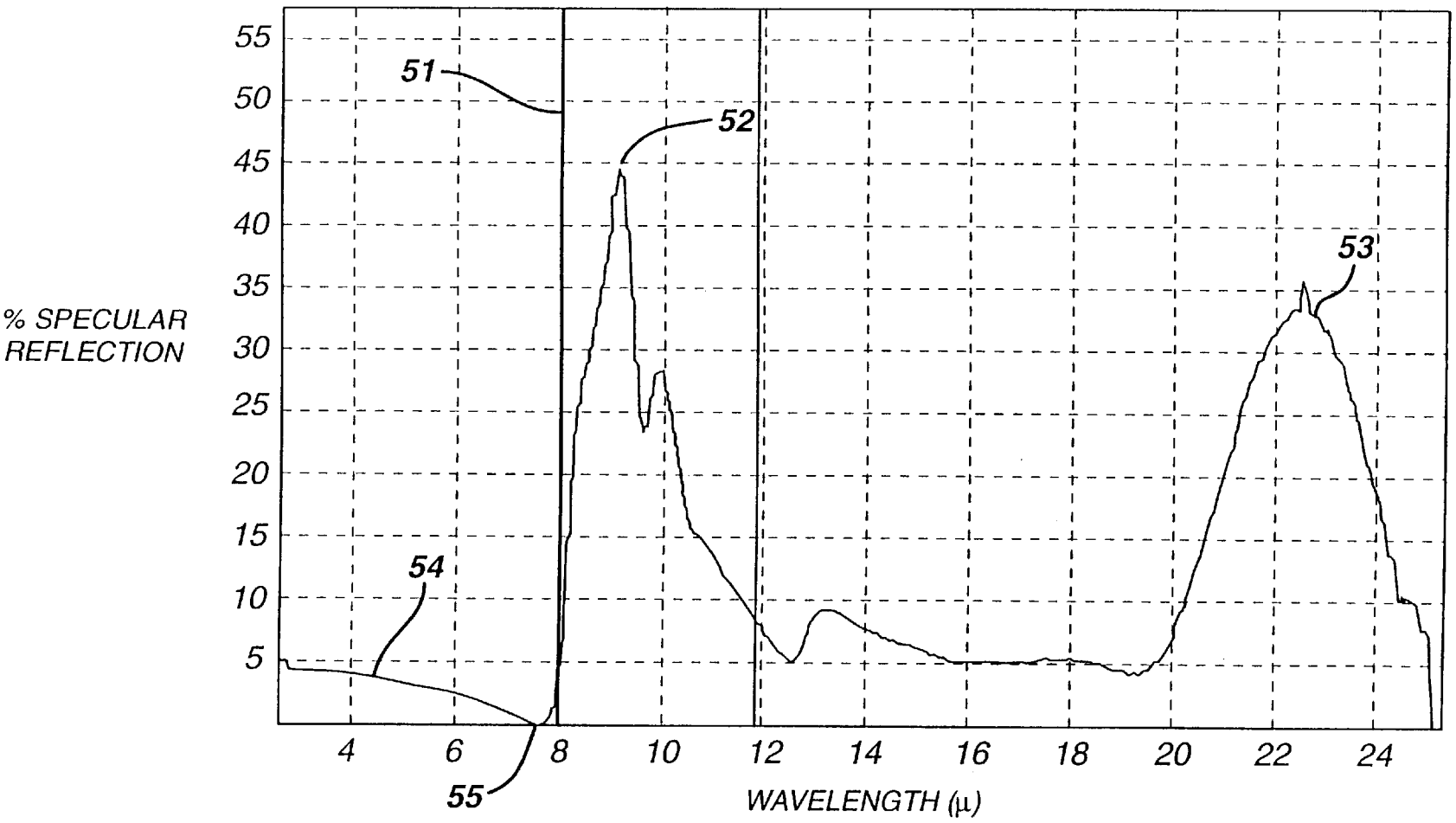
FIG. 7 is a graph of the reflection properties of a typical glass ceramic cooktop.

FIG. 7 is a graph of the specular or mirror-like reflection characteristics 50 in the $2.5\mu$–$26\mu$ region of a typical glass ceramic cooktop. As FIG. 7 indicates, there is a very large and broad peak 52 of reflection . Region 51 includes wavelengths smaller than peak 52 and separates peak 52 from a broad region 54, which exhibits decreasing reflection as wavelength increases. The region of increasing wavelengths beyond $12\mu$ is essentially rather large, variable, and contains other peaks, such as peak 53. The preferred wavelength sensitivity range of the sensors according to the present invention include the range where the reflection of the glass ceramic is as small as possible; these ranges are referred to as the minimum reflectivity wavelength region. The region 54, and especially the part of region 54 close to the minimum reflection area 55, are examples of such wavelength ranges. These wavelength ranges are complemented with the consideration of transmission to obtain the preferred regions of operation of the sensor according to the present invention. It should be noted that these wavelength ranges are cited as examples, and do not constitute limitations of the invention disclosed herein.

An additional approach is based upon sensing radiation in a wavelength range to which the cooktop is transparent, thereby effectively "looking" through the cooktop to detect the temperature of the cooking utensil by using wavelengths, for example, 3.5–$4\mu$, in which the cooktop is transparent. This latter embodiment is most useful for the large temperature values, for example, 150° C., of the cooking utensil or the content of the utensil.

Figure 8:
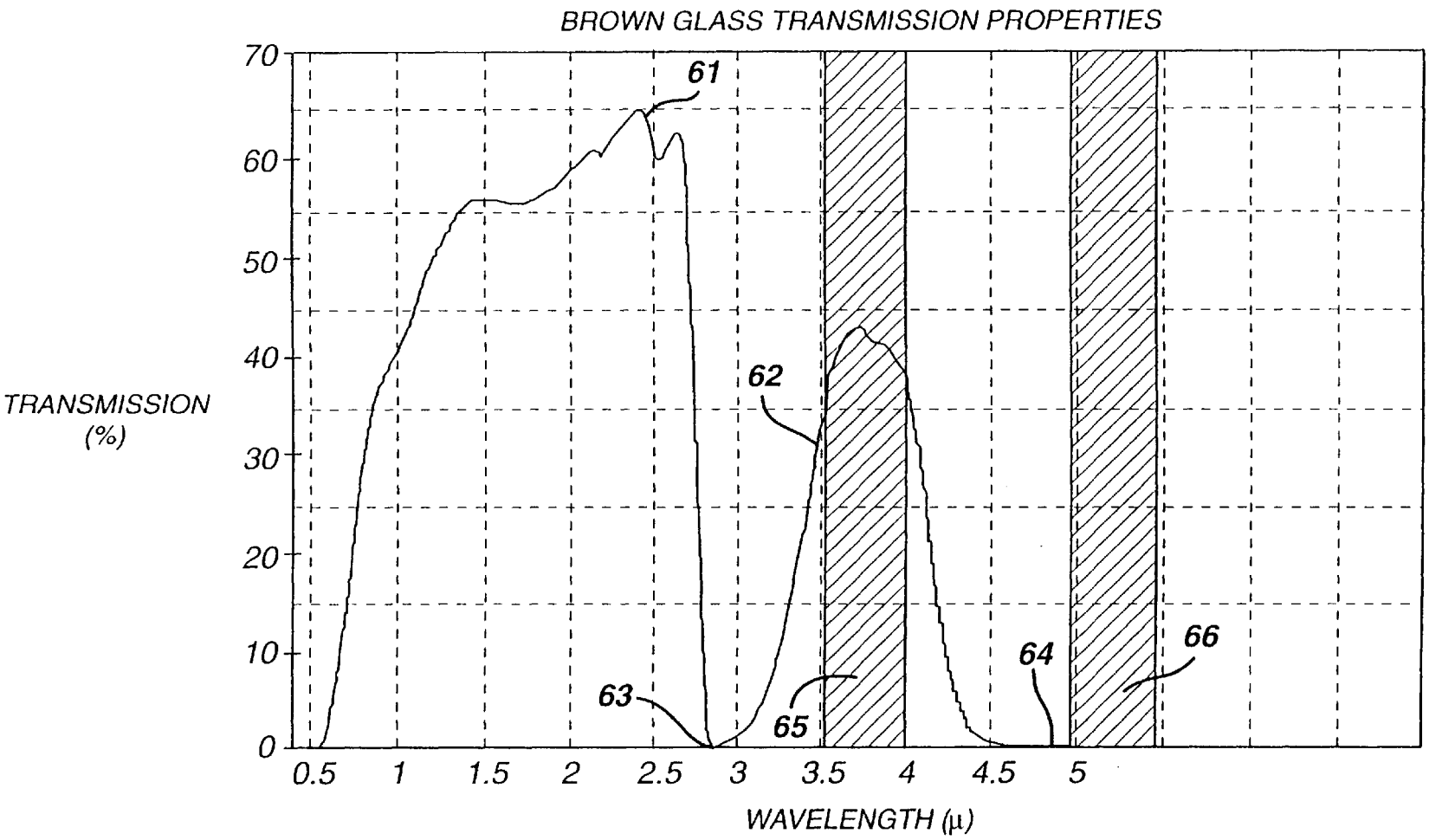
FIG. 8 is a representation of FIG. 6 showing wavelength ranges sensed by two differently filtered detectors.
Figure 9:
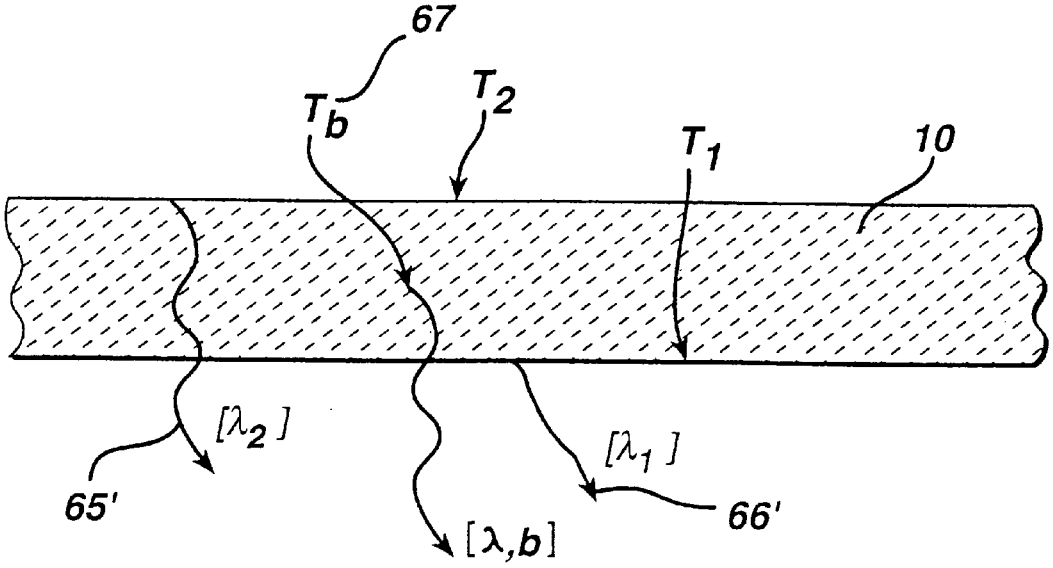
FIG. 9 shows the radiation in the wavelengths ranges represented in FIG. 8 radiating from upper and lower surfaces of partial, cross-section of a glass ceramic cooktop.

FIG. 8 is a representation of FIG. 6 showing wavelength ranges detected by two differently filtered detectors. FIG. 9 shows the radiation in wavelength ranges represented in FIG. 8 radiating from upper and lower surfaces of partial, cross-section of a glass ceramic cooktop. Referring again to FIG. 4, in the preferred embodiment, detector 24' operates as a main detector, and one or more detectors 24" optionally have wavelength sensitivity ranges different than that of detector 24'. In an alternative embodiment, any two detectors 24' or 24", now referred to as $D_1$, $D_2$, respectively, directed toward the same field of view are arranged to enable calculations dependent on two wavelength ranges. To accomplish these calculations, the two detectors include filters selected to limit their respective sensitivities to the bands or wavelength ranges $\{\lambda_1\}$ 65 and $\{\lambda_2\}$ 66, as shown in FIG. 8. The ranges $\{\lambda_1\}$ $\{\lambda_2\}$ are provided as examples, but optionally are selected to correspond to the radiation $E\{\lambda_1\}$ 65' emitted from the upper surface of the glass ceramic and the radiation $E\{\lambda_2\}$ 66' emitted from the lower surface of the glass ceramic, as shown in FIG. 9.

The respective output of detectors $D_1$, $D_2$, i.e., $V_{D1}$, $V_{D2}$, is indicative of, and directly related to, the temperatures $T_1$,$T_2$ at respective lower and upper surfaces of the glass ceramic. Because in general, the heat flux through a slab is proportional to the difference in opposing surface temperatures, the difference in the above temperatures, $T_1-T_2$, as given by Fourier's law, enables the flux through the glass ceramic to be obtained directly, according to the invention as described herein. In an alternate embodiment, temperature $T_2$ is optionally replaced by the bulk temperature $T_b$ 67, where bulk temperature is defined as the temperature in the center of a cross-section of the glass ceramic cooktop. The explicit values of the wavelength ranges are relatively narrow ranges, for example, $\pm 0.2\mu$ centered about $5\mu$–$7\mu$ for $\{\lambda_1\}$ 65, and $2.7\mu$–$4.3\mu$ for $\{\lambda_2\}$ 66. The actual mathematical relationship is dependent upon the explicit wavelength ranges selected, but is given by Plank's law, as integrated with the transmission characteristics of the filter. In the case of the flux measurement as described herein, the differences of (i.e., the functions of) the detector outputs $V_{D1}$ and $V_{D2}$, such as $V_{D1}-V_{D2}$, or $(V_{D1})^m-(V_{D2})^m$. In the case of a broad band filter, the exponent m is given as ¼. Some advantages of this approach include the elimination of any additive error sources from the detector output such as the reflection effects. The ratio of these two voltages, on the other hand, is used to calculate a result that provides substantial independence from the emissivity effects of the glass ceramic.

Regardless of the number and type of optical detectors utilized, the detectors are all connected to signal processing circuitry, illustrated generally at 38 in FIG. 1, which, in turn, supplies a signal or a plurality of signals to a processor 40 indicative of the temperature of the cooktop 10 or the voltages such as $V_{D1}$ and $V_{D2}$. The processor 40 optionally carries out calculations to remove the effects of noise and optical interference such as reflectivity effects and interference through the glass when the detector sensitivity is selected in the range where the glass is partially transparent. The processor 40 optionally automatically controls the temperature of the heating coil 18 or energy source according to a predetermined desired temperature, or reduce the temperature of the heating coil 18 when the temperature of the cooktop 10 reaches a predetermined maximum. Additionally, the processor optionally actuates an indicator, such as an audible, visible, or data indicator 44, indicating that the temperature of the cooktop 10 has reached a predetermined level.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A control and monitoring system for determining at least the temperature of a cooktop positioned above at least one controllable energy source and having a utensil disposed on the cooktop, the control and monitoring system comprising:

at least one detector for detecting infrared radiation and generating a detector signal representative of at least the temperature at least one of the cooktop and the utensil;

at least one filter connected to the at least one detector for limiting the infrared radiation into at least one predetermined infrared radiation wavelength range comprising at least one of a first infrared wavelength range representative of infrared radiation from the cooktop and a second infrared wavelength range representative of infrared radiation from the utensil, the detector signal being generated from the detected infrared radiation in the predetermined infrared radiation wavelength range; and at least one processor connected to the at least one detector for determining at least one parameter based on at least the at least one detector signal.

2. The system of claim 1 further comprising at least one controller connected to the at least one controllable energy source and to the at least one processor for controlling radiated energy generated by the at least one controllable energy source based on at least the at least one parameter determined by the at least one processor.

3. The system of claim 2 wherein the at least one controller is connected to the at least one detector and the at least one controllable energy source and receives the at least one detector signal for controlling radiated energy generated by the at least one controllable source based on at least the detector al signal.

4. The system of claim 3 further comprising at least one indicator connected to the at least one detector for indicating based on the at least the detector signal at least one of the current cooktop temperature and the occurrence of the cooktop reaching a predetermined temperature.

5. The system of claim 4 wherein the indicator comprises at least one of a visual indication, an audible indication and a data indication.

6. The system of claim 1 wherein the control and monitoring system further comprises an energy source housing that i s positioned below the cooktop for housing the at least one controllable energy source, the energy source housing comprising an opening through which the at least one detector detects the infrared radiation from the cooktop.

7. The system of claim 1 further comprising a compensator connected to the at least one detector for compensating the detector signal based on at least one feature selected from the group consisting of exclusion of ambient temperatures, removal of interference effects, and noise removal and signal conditioning.

8. The system of claim 7 wherein the at least one processor further comprises the compensator.

9. The system of claim 1 wherein the at least one detector is selected from a group consisting of thermal detectors and photon detectors.

10. The system of claim 1 wherein the at least one predetermined infrared radiation wavelength range comprises at least one of an opaque wavelength region of the cooktop and a minimum reflectivity wavelength region of the cooktop.

11. The system of claim 1 wherein the cooktop comprises an upper surface and a lower surface bounding a cross-sectional area having a bulk temperature and the at least one detector signal is directly related to at least two of infrared radiation from the lower surface of the cooktop, infrared radiation from the upper surface of the cooktop, and infrared radiation from the cross-sectional area of the cooktop.

12. The system of claim 11 wherein the at least one processor calculates based on the at least one detector signal at least one of a heat flux value and an emissivity independent temperature value.

13. The system of claim 1 further comprising:

at least one radiation collector disposed adjacent to the cooktop surface for collecting incident infrared radiation;

at least one concentrator positioned adjacent to the at least one detector for concentrating the infrared radiation collected by the at least one radiation collector and providing the concentrated infrared radiation to the at least one detector; and at least one transmission path having first and second ends, the first end being disposed adjacent to the at least one radiation collector and the second end being disposed adjacent to the at least one concentrator, wherein the at least one transmission path directs radiation collected by the at least one radiation collector to the at least one concentrator.

14. The system of claim 13 wherein the radiation collector has a predetermined shape selected from the group consisting of a frustoconical surface shape, a paraboloid of revolution shape, and a compound parabolic shape.

15. The system of claim 13 wherein the at least one radiation collector collects radiation from a predetermined field of view of the cooktop.

16. The system of claim 15 wherein the predetermined field of view of the cooktop comprises at least one a heated area of the cooktop surface and a portion of the cooktop surface.

17. The system of claim 13 wherein the at least one transmission path comprises at least one of a waveguide, non-imaging optics, and imaging optics.

18. The system of claim 13 wherein the at least one transmission path comprises a waveguide for directing infrared radiation onto the at least one concentrator.

19. The system of claim 18 wherein the waveguide comprises at least one hollow tubular element having an inner surface with an infrared radiation reflective coating.

20. The system of claim 18 wherein the waveguide comprises a solid element composed of an infrared radiation transmitting material having an infrared transmission band in a predetermined wavelength range.

21. The system of claim 20 wherein the predetermined wavelength range of the solid element is selected from the group consisting of an opaque wavelength region of the cooktop, a minimum reflectivity wavelength region of the cooktop, a 5–8$\mu$ wavelength region and 3.5–4$\mu$ wavelength region.

22. The system of claim 13 wherein the at least one detector further comprises a plurality of detectors positioned adjacent to the second end of the at least one transmission path.

23. The system of claim 13 wherein the at least one concentrator is disposed between the second end of the transmission path and the at least one detector.

24. The system of claim 13 wherein the at least one concentrator comprises a predetermined shape selected from the group consisting of a paraboloid of revolution shape and a compound parabolic shape.

25. The system of claim 1 wherein the at least one parameter comprises at least one of a temperature value, a control value and an indicator value.

26. A method for determining at least the temperature of a cooktop positioned above at least one controllable energy source and having a utensil disposed on the cooktop, the method comprising the steps of:

detecting infrared radiation;

filtering the infrared radiation into at least one predetermined infrared radiation wavelength range comprising at least one of a first infrared wavelength range representative of infrared radiation from the cooktop and a second infrared wavelength range representative of infrared radiation from the utensil;

generating at least one detector signal from the detected infrared radiation in the at least one predetermined infrared radiation wavelength range, the at least one detector signal being representative of at least a temperature of at least one of the cooktop and the utensil; and calculating a parameter based on the at least one detector signal.

27. The method of claim 26 wherein the parameter is selected from the group consisting of a temperature value, a control value for controlling said at least one controllable energy source, and an indicator value.

28. The method of claim 26 further comprising the steps of:

determining when at least one of a temperature of the cooktop and a temperature of the utensil reaches a predetermined temperature, said step of determining based on the at least one detector signal; and indicating when at least one of the temperature of the cooktop and the temperature of the utensil reach the predetermined temperature.

29. The method of claim 28 wherein the step of indicating further comprises the step of activating an indicator when the predetermined temperature has been reached wherein the indicator is selected from the group consisting of a visual indicator, an audible indicator and a data indicator.

30. The method of claim 26 further comprising the step of compensating said at least one detector signal.

31. The method of claim 30 wherein the step of compensating compensates said at least one detector signal to remove at least one of ambient temperature, interference effects, and electronic noise.

32. The method of claim 26 further comprising the step of controlling the at least one controllable energy source based on the calculated parameter.

33. The method of claim 32 wherein the step of controlling the at least one controllable energy source further comprises the steps of:

calculating a function of a temperature of a lower surface of the cooktop and a temperature of an upper surface of the cooktop.

34. The method of claim 33 wherein the step of controlling the at least one controllable energy source comprises the step of:

calculating at least one of a heat flux value and an emissivity independent value wherein the heat flux value and the emissivity independent value are functions of the at least one detector signal.

35. The method of claim 33 wherein the function comprises at least one of a difference between the temperature of the upper surface and the temperature of the lower surface and a ratio of the temperature of the upper surface and the temperature of the lower surface.

36. A control and monitoring system for determining at least the temperature of a cooktop positioned above at least one controllable energy source and having a utensil disposed on the cooktop, the control and monitoring system comprising:

a radiation collector disposed adjacent to the cooktop surface for collecting incident infrared radiation;

a transmission path having first and second ends, the first end being disposed adjacent to the radiation collector wherein the transmission path directs infrared radiation collected by the radiation collector to the second end;

a concentrator positioned adjacent to the second end of the transmission path for concentrating the infrared radiation collected by the radiation collector;

a detector positioned adjacent to the concentrator for detecting the infrared radiation, the detector generating a detector signal representative of at least a temperature of at least one of the cooktop and the utensil;

a filter connected to the detector for limiting infrared radiation detected by the detector into a predetermined infrared radiation wavelength range comprising at least one of a first infrared wavelength range representative of infrared radiation from the cooktop and a second infrared wavelength range representative of infrared radiation from the utensil, the detector signal being based on the detected infrared radiation in the predetermined infrared radiation wavelength range; and a processor connected to the detector for determining a parameter based on the detector signal.

37. A method for determining at least the temperature of a cooktop positioned above at least one controllable energy source and having a utensil disposed on the cooktop, the method comprising the steps of:

detecting infrared radiation;

filtering the detected infrared radiation into at least one predetermined infrared radiation wavelength range comprising at least one of a first infrared wavelength range representative of infrared radiation from the cooktop and a second infrared wavelength range representative of infrared radiation from the utensil;

generating a detector signal based on the filtered infrared radiation, the detector signal being representative of at least a temperature of at least one of the cooktop and the utensil;

calculating a parameter based on the detector signal;

controlling the at least one controllable energy source based on the calculated parameter;

determining when at least one of the temperature of the cooktop and the temperature of the utensil reaches a predetermined temperature, said step of determining based on the detector signal; and indicating when at least one of the temperature of the cooktop and the temperature of the utensil reaches the predetermined temperature.

* * * * *